US005351952A

United States Patent [19]

Hackman

[11] Patent Number: 5,351,952

[45] Date of Patent: Oct. 4, 1994

[54] METHOD OF MATCHING GOLFER TO GOLF CLUB

[76] Inventor: Lloyd E. Hackman, 1322 Clubview Blvd. S., Worthington, Ohio 43085

[21] Appl. No.: 998,662

[22] Filed: Dec. 30, 1992

[51] Int. Cl.[5] ..... A63B 53/12

[52] U.S. Cl. ..... 273/77 A; 273/80 B

[58] Field of Search ..... 273/186.2, 186 R, 77 A, 273/77 R, 80 B

[56] References Cited

U.S. PATENT DOCUMENTS

| | | | |
|---|---|---|---|
| 3,945,646 | 3/1976 | Hammond | 273/186.2 |
| 4,555,112 | 11/1985 | Masghati | 273/77 A |
| 4,615,526 | 10/1986 | Yasuda et al. | 273/186.2 |
| 4,630,829 | 12/1986 | White | 273/186.2 |
| 4,858,934 | 8/1989 | Ladick et al. | 273/186 R X |
| 4,878,672 | 11/1989 | Lukasiewicz | 273/186.2 |
| 4,940,236 | 7/1990 | Allen | 273/186 R X |
| 4,967,596 | 11/1990 | Rilling et al. | 273/186.2 X |
| 4,991,850 | 2/1991 | Wilhlem | 273/186 R X |
| 5,163,681 | 11/1992 | Hodgetts | 273/77 R |

*Primary Examiner*—George J. Marlo
*Attorney, Agent, or Firm*—Frank H. Foster

[57] ABSTRACT

A method for measuring the swing time of a golfer's swing and selecting a golf club having the inverse of four times its natural frequency which is approximately equal to the swing time. The golfer's swing time is defined as the time elapsed between maximum acceleration of a club head during downswing until ball impact. In the preferred embodiment, an accelerometer is mounted within the club head and is connected to an electronic data processor. A graph of club head acceleration versus time is plotted and the swing time is measured from the graph, between peak acceleration and ball impact.

7 Claims, 2 Drawing Sheets

METHOD OF MATCHING GOLFER TO GOLF CLUB

TECHNICAL FIELD

This invention relates to the field of sports equipment, and more specifically to methods for matching a golf club's natural frequency of oscillation to a golfer's swing time.

BACKGROUND ART

In the sport of golf, it is desirable for a golfer's swing to be the same when using any golf club in the golfer's set of clubs. This consistency results in consistently straight and predictable distance drives. With a typical set of golf clubs a golfer is required to slightly adapt his swing according to different characteristics of each different club in order to obtain a straight and maximum distance drive with that club. It is desirable, however, that every golf club in a set have similar characteristics to allow a golfer to keep a consistent swing and obtain the optimum results with each club.

A golf club is effectively a cantilevered beam (a club shaft held rigidly at a hand gripped end) having a mass (a club head) mounted to one end opposite the hand gripped end. The golfer's swing begins with the take away during which the golfer raises the club from addressing the ball to a raised position. The club is then reversed and the club is swung downwardly. At the beginning of a golfer's downward swing, the grip end of the club is first moved by the golfer's hands and the club shaft flexes, momentarily leaving the massive head in place. The shaft flexes in reaction to this acceleration and any momentum from the take away. Golfers want the shaft to have straightened from the flexed position and be moving forward at the point in the swing at which the club head impacts the ball, in order to maximize the velocity of the club head. This maximum head velocity maximizes the energy transferred to the golf ball, contributed by the shaft assisting in driving it as far as possible with that club. Additionally, with the club shaft straight, an angled face of the club head is correctly oriented with respect to the shaft, giving the ball the specified loft for that club.

It is desirable that each of the different clubs in a golfer's set have the same characteristics that cause the club shaft to be straight at ball impact. By having the same characteristics, each club can be swung identically, giving optimum results and allowing the golfer to perfect his swing and obtain consistent results. The problem with making each golf club in a set identical is in determining the characteristics of each golf club that are to be identical, determining certain characteristics of each golfer's swing, and matching a golf club to a particular golfer's swing.

Numerous patents have been issued for means and methods for determining characteristics of golfers' swings. Hammond, in U.S. Pat. No. 3,945,646, teaches to mount accelerometers at various locations in a golf club. The accelerometers are electrically connected to a data processor which calculates certain position related characteristics of the golf club during a golfer's swing. This invention uses the accelerometers for analyzing the swing of a particular golfer to correct the swing, not for determining characteristics of a golfer and then matching those characteristics to golf clubs.

In U.S. Pat. No. 4,615,526, Yasuda et al. mount magnets and sensors to a golf club and a platform. The apparatus is used during the swing of the club to determine the velocity of the club head and angle of approach at, and near, ball impact. These characteristics of the golfer's swing are also used to analyze a golf swing for the purpose of correction, not to match a golfer to a golf club.

Additional U.S. Pat. Nos. 4,630,829, 4,878,672, 4,967,596, and 4,991,850 teach the use of electrical and mechanical devices for measuring velocity, centrifugal force during club swing, and impact energy of a ball with a club head. Most of these inventions are used to determine characteristics about a golfer's swing in order to correct or change the golfer's swing. One of the prior art inventions uses characteristics of a golfer's swing to determine the flexibility a golf club shaft should have for that golfer.

It is known to take a plurality of golf clubs that have different natural frequencies of oscillation and, by trial and error, find the natural frequency of a golf club that best matches a particular golfer. This is done by the golfer taking numerous swings with each golf club, and choosing the one which gives the golfer the best respective results, such as drive distance and straightness of drive.

The need exists for a method for measuring specific characteristics of a golfer's swing, and matching a golf club or a set of golf clubs to those characteristics.

BRIEF DISCLOSURE OF INVENTION

The invention is a method for matching a golfer to a golf club to maximize club head momentum upon ball impact. The golf club has a mode of oscillation of a cantilevered beam having a spring constant arising from the flexural and torsional stiffness of the club shaft, the golf club being held at a grip end of a club shaft with a club head mounted to the opposite end of the shaft. The club head oscillates along an arcuate path centered at the grip end of the beam. The method comprises measuring the golfer's swing time from maximum club head acceleration until ball impact. A golf club having the inverse of four times its natural frequency approximately equal to the golfer's measured swing time is selected for the golfer.

Figure 1:
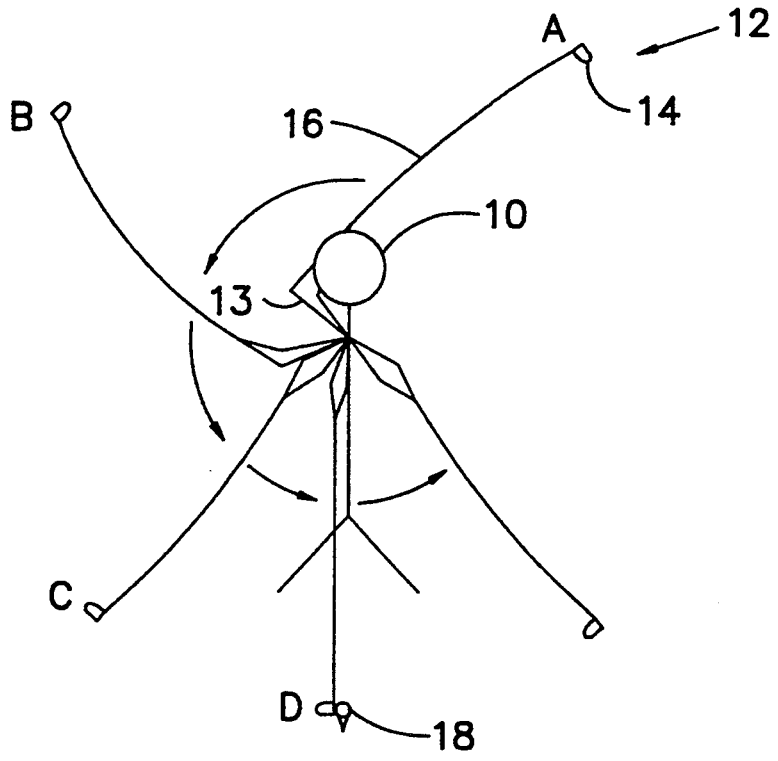
FIG. 1 is a schematic view illustrating a golfer in progression through a golf swing.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose.

DETAILED DESCRIPTION

A golfer 10 is illustrated in FIG. 1 swinging a golf club 12 through multiple positions of a typical golf swing. With the club head at rest at position A, the golfer 10 begins his golf swing, accelerating the golf club 12 by applying a force to a grip end 13 of the club 12. The golf swing begins when a club head 14 initiates a downward acceleration. This is either when the golf club 12 is at rest and a downward force is applied to begin the swing downward, or when the golf club 12, having an upward velocity due to backswing, is suddenly stopped and reversed in direction by a downward force, initiating downswing. When the grip end of the club is accelerated, the club shaft begins to be deflected and begins to apply a force to the club head. That force is a spring force equalling the product of the amount of deflection multiplied by the spring constant. The spring force begins accelerating the club head in accordance with Newton's law F=ma. As club shaft deflection is increased by the force applied to the grip by the golfer, resulting in acceleration of the grip, the acceleration increases until maximum deflection is reached at point B.

Therefore, when the club head 14 reaches position B, it has an increased velocity, and maximum stored energy for maximum acceleration to a higher total velocity at impact. Additionally, the flexible golf club shaft 16 has deflected a maximum amount from its initially straight, undeflected shape. Acceleration then decreases while club head velocity continues to increase. When the golf club 12 reaches position C, the velocity of the club head 14 is increased still further and the acceleration is decreased from its positive maximum at position B, with the shaft 16 somewhat straighter.

When the golf club 12 reaches position D, an infinitesimal instant before impact with a ball 18, the club head 14 preferably has maximum velocity, and the acceleration of the club head 14 is approximately zero. At the instant of impact with the ball 18, the acceleration of the club head 14 becomes negative and its velocity decreases (deceleration) almost instantaneously, due to the significant energy transfer from the club head 14 to the ball 18. The shaft 16 is preferably straight when the club head 14 impacts the ball 18. After the ball 18 has been hit and is driven away from the club head 14, the club head 14 acceleration changes positively, increasing towards zero from its negative value.

Figure 5:
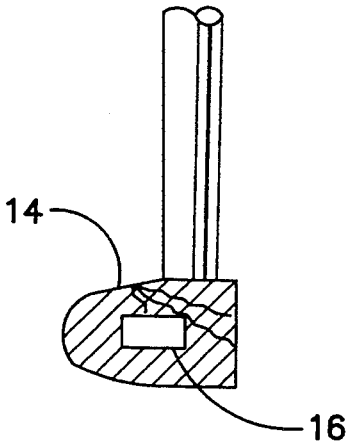
FIG. 5 is a side view in section illustrating a preferred embodiment of the present invention, and FIG. 6 show a plot of swing time (t) verus natural frequency of vibration (f) for three examples, without using specific values.
Figure 6:
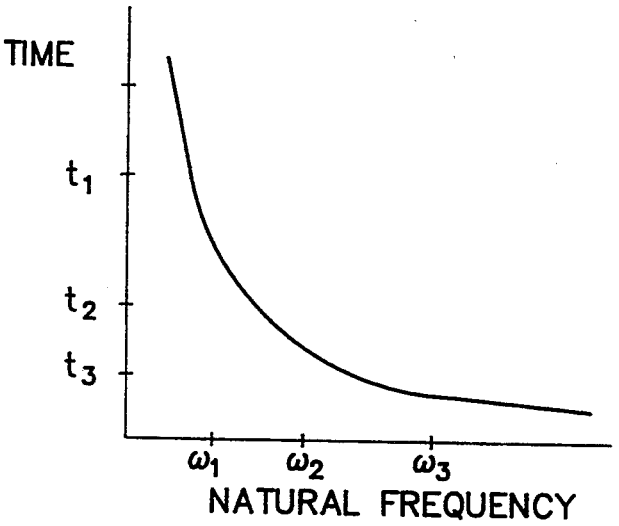

In the preferred embodiment of the present invention an accelerometer 19 is mounted in the club head 14, as shown in FIG. 5 in detail, to measure the above described changes in acceleration, with respect to time, that the club head 14 undergoes. By connecting the accelerometer 19 to an electronic data processor (not shown), it is possible to plot a graph of acceleration versus time according to the data received from the accelerometer 19.

Figure 2:
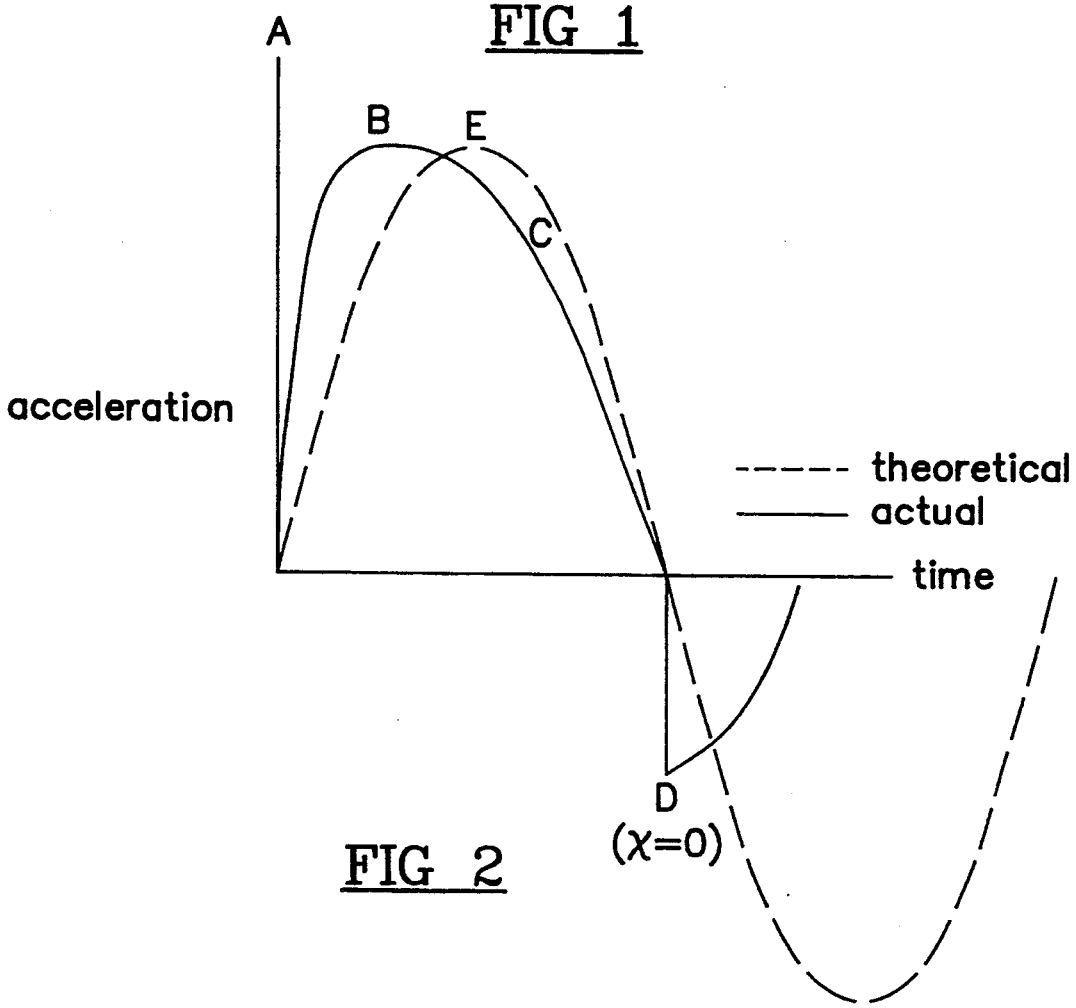
FIG. 2 is a graph illustrating acceleration versus time.

A graph of acceleration versus time is illustrated in FIG. 2. The positions A, B, C and D on the graph of FIG. 2 correspond with the positions A, B, C and D of the golf swing illustrated in FIG. 1.

The graph of FIG. 2 shows both a theoretical curve and an actual curve. The actual curve is the curve obtained With the preferred embodiment when an accelerometer 19 is mounted in a golf club head and a golfer performs his typical golf swing. The theoretical curve represents perfectly periodic motion of an oscillating cantilevered beam for purposes of explanation. The actual curve differs from the theoretical curve due to the transient, nonperiodic force applied by a golfer at initiation of the golfer's swing due to the nonperiodicity inherent in human motion.

In determining the swing time of a golfer, the time elapsed between position B (the maximum acceleration) and position D (the drop in acceleration characteristic of impact with the ball) on the actual curve of FIG. 2 is measured. This time value is one-fourth of the period of a theoretical curve which the actual curve approximates. Since the period is the inverse of the natural frequency ($\omega n$), the ideal and preferred measured swing time is $$\text{swing time} = \frac{1}{4\omega_n}.$$

Since the motion of a golfer initiating downswing is a transient motion, it introduces start-up error, or discrepancies relative to ideal periodic motion. A golfer does not apply a periodic, sinusoidal driving force to the club grip which would be characteristic of the study of the periodic motion of resonant bodies. Instead, the golfer applies an accelerating force which is principally at the beginning of the swing and decreases as the swing progresses beyond point B early in the swing and therefore the peak of the actual force is shifted toward the beginning of the swing. Therefore, a correction factor must be used in calculating the golfer's swing time. Therefore, the equation $$\text{Swing time} = \frac{1}{4\omega_n}$$

is only approximate for a golfer's swing, and requires a correction factor k giving $$\text{Swing time} = \frac{k}{4\omega_n}.$$

The object of the present invention is to measure the above swing time of a golfer's swing and calculate a natural frequency of a golf club that will result in maximum net club head velocity at the time of ball impact. A golf club having the calculated natural frequency then matches to the golfer's swing time.

For testing purposes, it is well known to mount a conventional golf club at the grip end rigidly in a machine, displace the club head and release it, causing the club to oscillate about the grip end along an arcuate path. This mode of oscillation is illustrated by the theoretical curve of FIG. 2. It is also known that the frequency of oscillation of that golf club is its natural frequency. By varying both the length of the club shaft, stiffness of the club shaft, and the mass of the club head, the natural frequency of the golf club can be varied.

Figure 3:
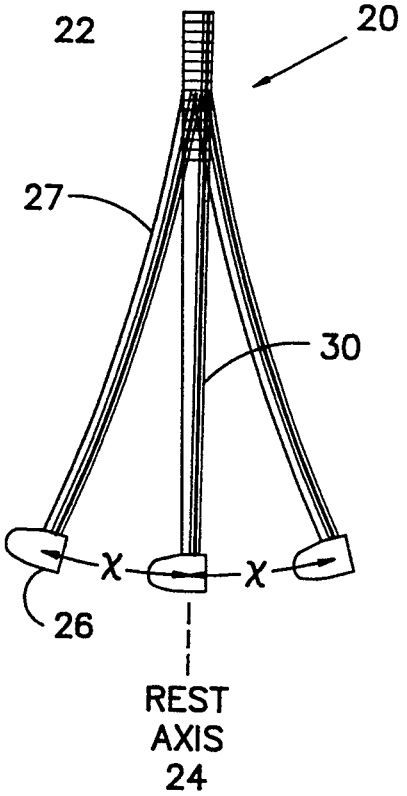
FIG. 3 is a side view illustrating deflection positions of a golf club.

An illustration of a golf club 20 oscillating about a grip end 22 is illustrated in FIG. 3. The golf club 20 is shown as it deflects when it is swung through a typical golf swing or, similarly, as it is oscillated when held in a machine. An imaginary rest axis 24, extends from the grip end 22 and passes linearly through the undeflected golf club shaft 30, shown in the center of the illustration of FIG. 3. During deflection of the golf club 20 in either direction from the rest axis 24, the club head 26 is displaced a distance X from the rest axis 24, shown in FIG. 3.

The time changing acceleration of the machine mounted golf club 20 is illustrated by the theoretical curve shown in FIG. 2. When the oscillating golf club 20, held at its grip 22 end, passes through the rest axis 24 (at x=0), the acceleration of the club head 26 is zero and its velocity is maximum. It is at the rest axis 24 where the velocity of the club head 26 with respect to the rest axis 24 is maximum, and therefore where it is desirable that the club head 26 strike a golf ball when the club 20 is swung by a golfer.

The reason why a golfer wants maximum club head 26 velocity with respect to the rest axis 24 is that the golf club 20 has two velocity components when swung by a golfer. The first velocity component is the velocity of the club head 26 with respect to the rest axis 24 as described above. Secondly, there is the velocity of the moving rest axis 24 which is a function of the angular velocity of the golfer's hands at the grip 22 end. The net velocity is the sum of these two velocities. It is most desirable to maximize the velocity of the club head 26 with respect to the rest axis 24 at ball impact to maximize the net velocity of the club head 26 upon impact. This will impart maximum momentum to the golf ball, and will drive the golf ball the greatest distance for the particular golf club.

There is a slight difference between the way the force is applied by a person swinging a golf club holding it at the grip end, and the way the force is applied when the golf club is in a machine measuring the natural frequency. A correction factor, as described above, will be necessary for correcting this discrepancy between perfect periodic motion and actual motion of golfer's swings.

The theoretical, periodic motion of the oscillating golf club of FIG. 3, shown graphically in FIG. 2, is what the present invention is assuming a golfer's swing approximates. As a golfer progresses through his swing, the acceleration reaches a peak value and then decreases to zero over time and takes a characteristic negative plunge at ball impact. If the time between peak acceleration and ball impact is measured (with an accelerometer) and is equated to the inverse of four times the natural frequency of a golf club (as measured in a machine), the golfer using that golf club should have a straight club shaft, and have maximum net velocity of the club head at ball impact.

As the club head decreases in acceleration from peak acceleration in the golfer's swing, the approximating assumption is made in this analysis that the decrease in club head acceleration from peak to zero occurs instantaneously allowing the club head to move as a freely oscillating body back toward its rest axis. This assumes a complete lack of force applied by the golfer on the club after the peak acceleration is reached at point B. This lack of force causes the deflected shaft of the club to begin to straighten as a freely oscillating body with the rest axis having constant velocity and zero acceleration. In the case of a machine holding a golf club which is bent and just released to oscillate, the rest axis also has no acceleration, allowing for the analogy to be drawn between a golf club being swung and one in a machine. Therefore, the measurement of time between maximum acceleration (analogous to release of the bent machine held club) and ball impact (at x=0 for machine held club) departs only from the club held in the machine, and therefore has error, only to the degree that the acceleration of the rest axis for a golfer swinging does not actually decrease to zero instantaneously. Some time actually elapses between maximum acceleration and ball impact.

By assuming that once the club head reaches maximum acceleration in a golfer's swing, the club approximates a club mounted in a frequency measuring machine, the matching of a golfer's swing time to a particular golf club's natural frequency is mathematically accomplished with the above described equation.

Therefore, what is effectively being measured with the present invention is the amount of time it takes a deflected golf club shaft to straighten itself whether suddenly released when held in a machine, or suddenly released in a golfer's swing (assuming instantly decreasing acceleration to zero). The time is approximately equal to one-fourth the inverse of the natural frequency, herein called the swing time. The swing time is the amount of time it takes in a golfer's swing for the golf club to straighten itself from maximum deflection at peak acceleration. Assuming a good approximation of swing time, a golf club will be obtained which should straighten itself by the time ball impact occurs to give the club head the maximum net velocity for the particular golfer.

The preferred golf club, effectively a cantilevered beam, deflects a distance X under acceleration applied by a golfer swinging the club. The distance X the golf club head is deflected is proportional to the amount of acceleration of the golf club. The equation $$F=ma$$

where:

m is the mass of the golf club (primarily head); and a is the acceleration of the golf club shows that a force F applied to the golf club grip results in a proportional acceleration in the golf club. The equation $$F=xk$$

where:

x is the displacement of the club head from the rest axis; and k is the spring constant of the club shaft shows that a force F applied to a golf club grip by a golfer results in a deflection of the club shaft, proportional to the force applied. By equating the above equations, the resultant is $$ma=xk$$

This equation shows that an acceleration of the golf club results in a proportional deflection of the club shaft, displacing the club head a distance x from the rest axis, proportional to the acceleration applied. The preceding equations illustrate the effect that acceleration has on deflection of the golf club shaft, and the displacement x of the club head from the rest axis. Of course, a finite time must be allowed for an acceleration to result in a given deflection due to the mass of the golf club and the impossibility of instantly displacing a mass.

The purpose of the present invention is to first locate both the peak acceleration in a golfer's swing and the ball impact in a golfer's swing and determine the time between them. From that time interval, desired natural frequency for a club is determined. A golf club is then selected or custom made to have that natural frequency so it will complete the displacement from deflected to straight in the amount of time it takes the golfer to swing from maximum acceleration to ball impact.

If the golfer 10 in FIG. 1 swings the golf club 12 upwardly and does not consciously or knowingly stop the club 12 to allow the golf club shaft 16 to come to rest before initiating downswing, the present method of measuring swing time still works. By whipping the club 12 up in the upswing and then suddenly swinging it downwardly, the club head none the less instantaneously comes to rest. The deflection of the shaft 16 will be increased over starting the swing from a conscious rest, increasing velocity at the impact with the ball 18 if the golf club 12 is correctly chosen. The accelerometer method measures swing time as beginning at maximum downward acceleration. When the golf club 12 is swung upwardly and suddenly stopped and swung downwardly, the first application of force to the golf club 12 by the golfer 10 in the downward direction and will cause a downward acceleration to be sensed by the accelerometer. When this downward acceleration reaches a maximum, time will begin to be measured and will stop at ball impact. This is the same method used when the club 12 is allowed to come to rest prior to downswing initiation.

The accelerometer used in the present invention is of the type conventionally used, having small size and weight, capable of being mounted within a golf club head.

Figure 4:
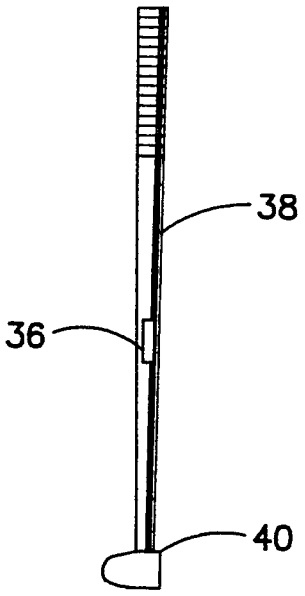
FIG. 4 is a side view illustrating an alternative embodiment to the present invention.

It is possible, as shown in FIG. 4, to install a strain gauge 36 on a golf club shaft 38 to sense deflection or stress of the golf club shaft 38 during the swing of a golfer. The strain gauge 36 would be connected to an electronic data processor which plots a graph of deflection versus time. The swing time is measured as beginning when deflection of the golf club shaft 38 begins to decrease after reaching a maximum, and ending at ball impact. To measure ball impact, a sensor, such as a piezoelectric crystal, can be installed in the face of the club head 40.

Although most people accelerate following the actual curve shown in FIG. 2, in which acceleration decreases after ball impact, an extremely strong person may continue accelerating after ball impact. For this person, the present method will still result in a golf club having a shaft which passes through the rest axis by measuring the swing time and equating it to the inverse of four times the natural frequency. Most people, however, have approximately zero acceleration at ball impact.

It is another object of the present invention to tune all of the golf clubs in a golfer's set to the natural frequency of the golfer's swing.

The swing time is defined above as the time between the maximum club head acceleration and ball impact (which gives a characteristic deceleration). Actual ball impact is not essential and can be determined by other means, such as by sensing club head position where impact would occur, for example by interrupting a light beam directed to a photo cell and passing through a location where the ball would be positioned. The acceleration curve can be narrower or broader than those shown in FIG. 2. The narrower curve will more quickly go from maximum to zero acceleration, more closely matching the assumptions made above, and vice versa for the broader curve. Additionally, the acceleration may reach a peak value and level off, dropping after some time, which will increase error, unless the time is measured from the time the acceleration begins to decrease, until ball impact. For most people the maximum acceleration coincides with the start of decreasing acceleration.

The graph of FIG. 2 is not necessarily representative of all golfers or even a lot of golfers, but is merely representative of one possible type of golf swing.

While certain preferred embodiments of the present invention have been disclosed in detail, it is to be understood that various modifications may be adopted without departing from the spirit of the invention or scope of the following claims.

I claim:

1. A method for matching a golfer to a golf club to maximize club head momentum upon ball impact, the golf club having a natural frequency of vibration in a mode of oscillation of a cantilevered beam that has a spring constant when held at a grip end of a club shaft, the club having a club head mounted to the opposite shaft end which oscillates along an arcuate path about the grip end, the method comprising:

(a) measuring the golfer's swing time from the moment of maximum club head acceleration during downswing until the moment of ball impact;

(b) selecting for the golfer a golf club wherein the reciprocal of four times the its natural frequency of vibration is substantially equal to the golfer's measured swing time.

2. A method in accordance with claim 1 wherein selecting further comprises measuring the natural frequency of a golf club in the mode of oscillation of a cantilevered beam.

3. A method in accordance with claim 2 wherein measuring further comprises mounting an accelerometer to a golf club, and measuring the difference in time between maximum acceleration and high deceleration of ball impact.

4. A method in accordance with claim 3 wherein the accelerometer is mounted to the club head.

5. A method in accordance with claim 4 wherein the method further comprises selecting golf clubs for an entire set of clubs, each club having the reciprocal of four times the natural frequency approximately equal to the golfer's measured swing time.

6. A method in accordance with claim 1 wherein measuring the golfer's swing time further comprises mounting at least one strain gauge to the shaft of a golf club, and measuring the difference in time between the moment of maximum deflection or stress of the golf club shaft, and the moment at desired ball impact.

7. A method in accordance with claim 6 wherein measuring the golfer's swing time further comprises mounting a sensor in the golf club head for indicating ball impact.

* * * * *